US011180890B2

(12) United States Patent
Delnoye et al.

(10) Patent No.: US 11,180,890 B2
(45) Date of Patent: Nov. 23, 2021

(54) FLUOROCHEMICAL-FREE OIL AND GREASE RESISTANT CELLULOSIC MATERIALS

(71) Applicant: Coöperatie AVEBE U.A., Veendam (NL)

(72) Inventors: Didier André Pierre Delnoye, Groningen (NL); John Beugeling, Gieten (NL); Simon Petrus Jozef Laan, Hoogezand (NL); Pieter Slor, Foxhol (NL); Jan Albert Bleeker, Haren (NL)

(73) Assignee: COÖPERATIE AVEBE U.A., Veendam (NL)

( * ) Notice: Subject to any disclaimer, the term of this patent is extended or adjusted under 35 U.S.C. 154(b) by 100 days.

(21) Appl. No.: 16/603,500

(22) PCT Filed: Mar. 9, 2018

(86) PCT No.: PCT/NL2018/050144

§ 371 (c)(1),
(2) Date: Oct. 7, 2019

(87) PCT Pub. No.: WO2018/186736

PCT Pub. Date: Oct. 11, 2018

(65) Prior Publication Data

US 2021/0017715 A1 Jan. 21, 2021

(30) Foreign Application Priority Data

Apr. 7, 2017 (EP) ..... 17165504

(51) Int. Cl.

| | |
|---|---|
| ***D21H 21/16*** | (2006.01) |
| ***D21H 19/38*** | (2006.01) |
| ***D21H 19/54*** | (2006.01) |
| ***D21H 19/62*** | (2006.01) |

(52) U.S. Cl.

CPC ..... *D21H 21/16* (2013.01); *D21H 19/385* (2013.01); *D21H 19/54* (2013.01); *D21H 19/62* (2013.01)

(58) Field of Classification Search

USPC ..... 162/135

See application file for complete search history.

(56) References Cited

U.S. PATENT DOCUMENTS

| | | | | |
|---|---|---|---|---|
| 4,327,148 | A * | 4/1982 | Toyama | B41M 5/1243 427/150 |
| 6,777,548 | B1 * | 8/2004 | Kesselmans | C08B 31/18 536/102 |
| 2003/0207051 | A1 * | 11/2003 | Kozumi | B41M 5/5218 428/32.1 |

FOREIGN PATENT DOCUMENTS

| | | |
|---|---|---|
| GB | 1229646 | 4/1971 |
| WO | 0006607 | 2/2000 |

OTHER PUBLICATIONS

ISO 5636-5, Gurley Method, Paper and board—Determination of air permeance (medium range), Third Edition, Nov. 1, 2013, pp. 1-4.

Lyne, et al., "Paper for ink printing", Tappi Journal, May 1985, pp. 106-110.

* cited by examiner

*Primary Examiner* — Mark Halpern

(74) *Attorney, Agent, or Firm* — Hoffmann and Baron, LLP

(57) ABSTRACT

The invention pertains to a cellulosic material provided with a coating comprising an oxidized carboxylated starch having a weight-average molecular weight of $0.3-10\times10^6$ Da and a water-soluble starch extender present in a quantity of 0 to 25 wt. % based on the coating dry weight, selected from a crosslinked cationic polyalkylene amine and a zirconium carbonate, as well as to use thereof in improving the oil and grease resistance of paper. The invention furthermore pertains to a method to improve the oil and grease resistance of a cellulosic material, comprising providing a cellulosic material, coating said material on at least one side with a homogenous aqueous composition comprising an oxidized carboxylated starch having a weight-average molecular weight of 0.3–10×106 Da and 0-3 wt. % of a starch extender, selected from a crosslinked cationic polyalkylene amine and a zirconium carbonate, and drying the cellulosic material.

14 Claims, No Drawings

FLUOROCHEMICAL-FREE OIL AND GREASE RESISTANT CELLULOSIC MATERIALS

This application is the U.S. National Phase of, and Applicants claim priority from, International Patent Application Number PCT/NL2018/050144 filed 9 Mar. 2018, which claims priority from EP 17165504.6 filed 7 Apr. 2017, each of which is incorporated herein by reference.

BACKGROUND

The treatment of paper and board with fluorinated compounds to achieve oil and grease resistance is well known in the prior art. The oleo repellency is based on a reduction of the surface energy of the substrate by fluorochemical agents. U.S. Pat. No. 3,811,933 describes oil and grease resistant paper treated with a coating composition comprising a fluorocarbon polymer. However, the use of carbonfluor chemicals has raised public concerns due to their tendency to bioaccumulate and suspected health and environmental risks. Therefore there have been made attempts to provide carbonfluor free oil and grease resistance to paper and board.

CA2467601 describes a non-fluorocarbon oil and grease resistant paper supplying comprising a pre-selected starch derivative, a flexibility enhancing agent and a rheological agent. The starch derivative is a chemically modified starch. However, these compositions require a relatively high coat weight of 10 to 32 g/m$^2$ per side to achieve reasonable oil and grease resistance.

EP1292639B1 describes a coating resistant to the penetration of oil, comprising a starch material selected from modified starch and waxy starch, and a plasticizer in ratio at least 0.5:1, wherein the starch comprises modified starch with a DS between 0.015 and 0.030 and has Mw from 100.000 to 2.000.000. Disadvantage of this invention is that the mixtures of EP1292639 exhibit very high viscosities which are difficult to apply on paper or board with ordinary application devices present in the paper industry. Typical viscosities range between 1700 and 2400 mPas at 14% dry solids and 98° C., which are very high for application. Another disadvantage of EP1292639 is that the oil and grease resistance is achieved using high coat weights, typically between 16 to 19 g/m$^2$. Moreover, the used low molecular weight plasticizers such as glycerol have the tendency to migrate into food products, which is unwanted.

US2009/0297842 describes a starch-oxide in combination with alkylene diketene dimer (AKD) to achieve oil and grease resistance of paper. US2009/0297842 also describes the use of crosslinkers to improve oil and grease resistance. It is shown that the oil and grease resistance is achieved due to the addition of the AKD emulsion. The combination of the starch oxide and crosslinker does not impart oil and grease resistance. AKD is a wax type product and the objective of the invention is to impart oil and grease resistance to paper or board without using any waxes.

DETAILED DESCRIPTION

The present invention discloses a cellulosic material provided with a coating comprising an oxidized carboxylated starch having a weight-average molecular weight of 0.3–10×10$^6$ Da and a water-soluble starch extender present in a quantity of 0 to 25 wt. % based on the coating dry weight, selected from a crosslinked cationic polyalkylene amine and a zirconium carbonate.

It has been found that it is possible to considerably improve the oil and grease resistance of a cellulosic material by coating the material with a coating comprising an oxidized carboxylated starch and 0-25 wt. % of a starch extender, selected from a crosslinked cationic polyalkylene amine and a zirconium carbonate.

Without wishing to be bound by theory, it is anticipated that the carboxylic acid groups of the oxidized carboxylated starch provide improved interaction with the cellulosic material, and that the starch extender interacts with carboxylic and potentially phosphate groups on the starch backbone to form an extended starch network which binds well to the cellulosic material.

Cellulosic material, as used herein, refers to solid materials comprising a network of cellulose fibers and potentially various additives and/or other fibers or polymers, which are flat and, in most cases, flexible to some extent. Well-known examples include paper and cardboard. It is well-known in the art how to obtain cellulosic materials, which may benefit from imparting oil- and grease resistance. Applications in which oil and grease resistance of cellulosic materials is important, include for example artistic paper or packaging materials, in particular packaging of objects with a greasy surface, such as the packaging of food, pet food, cosmetics, vitamins, nutritional supplements, pharmaceuticals, or technical products. Much preferred use includes use for packaging, importantly food items.

Preferably therefore, the starch extender and the oxidized carboxylated starch comply with food contact paper and board regulations and guidelines, as they are known in the art. However, the oil- and grease resistant cellulosic materials may also be applied for other purposes, which purposes can readily be envisioned by the skilled person.

Preferably, the cellulosic material has low porosity and/or high smoothness. Porosity and smoothness of paper are well-known variables in the art of paper-making.

Porosity can be determined by measuring the Gurley porosity (NEN ISO 5636-5), as is known in the art. The Gurley porosity number is a measure of the time required for 100 ml of air to penetrate through a paper. A high Gurley porosity number thus represents a paper with low porosity, and a low Gurley porosity number represents a paper with high porosity. A cellulosic material of the invention preferably has a low porosity, which is generally known to mean a porosity of larger than 250 s/100 ml, preferably more than 500 s/100 ml, more preferably more than 800 s/100 ml, most preferably more than 1000 s/100 ml.

Smoothness is determined with an apparatus that complies with the print surface method to measure the roughness of paper or board (ISO-8791/4). The roughness is expressed in μm. High smoothness is generally known to mean a roughness of less than 7 μm, preferably less than 6 μm more preferably less than 5 μm on at least one side of the paper sheet.

Oil- and grease resistance, as used herein, is defined as the resistance of paper to the penetration or transmission of oil and grease, i.e. fatty materials. An oil- and grease resistant cellulosic material retains its strength upon contact with fatty materials. Oil- and grease resistance can be measured by the ASTM F119. This test method provides standard conditions for determining the rate of grease penetration of flexible barrier materials, as set forth in the Examples. The method measures the time needed for an oil or grease to penetrate through the material. It is believed that this method is a more valid method to measure the barrier properties of an oil and grease resistant material in comparison to the method according to Tappi method T559. This method is often used to assess the oil and grease resistance of fluorochemical treated papers and board. The oleo-repellency is tested with a series of numbered reagents, varying in surface tension and viscosity. However, as the coating of the current invention does not reduce the surface energy of the paper sheet, Tappi T559 is not longer a valid method to assess the level of resistance.

The cellulosic material of the invention is provided with a coating comprising an oxidized carboxylated starch and 0-25 wt. % of a water-soluble starch extender. A coating, in this respect, refers to a layer applied uniformly and directly on the surface of at least one side of the cellulosic material. In some embodiments, the coating is applied to one side of the cellulosic material. In other embodiments, the coating is applied on both sides of the cellulosic material.

An advantage of the coatings of the present invention is that due to the increased oil- and grease resistance, the coating weight may be less than in known applications. The coating is present on the cellulosic material in a quantity of 0.5-7.5 g/m$^2$ starch per side based on dry weight, preferably 0.5-5 g/m$^2$ starch per side, more preferably 0.75-4 g/m$^2$ starch per side, even more preferably 1-3 g/m$^2$ starch per side. The quantity of starch on paper may be determined as described in the examples under "surface size starch determination".

Starch is a polymeric carbohydrate (polysaccharide) based on a large number of glucose units joined by glycosidic bonds. Native starch comprises amylopectin and amylose in varying proportions, depending on the source; amylose is a linear (non-branched) polysaccharide, whereas amylopectin is a branched polysaccharide. Starch of the present invention can be any starch, such as legume, cereal, root or tuber starch. In preferred embodiments, the starch is a root or tuber starch, most preferably a potato starch (starch of *Solanum tuberosum*). Potato starch differs from other starch types because potato starch comprises covalently attached phosphate groups, in contrast to other starch types.

The starch used in the present invention may be a native starch, which is starch comprising approximately 70-90 wt. % amylose and 1-30 wt. % amylopectin, depending on the type of starch. The starch may also be a waxy (amylopectin-rich) starch, which is starch comprising at least 90 wt. %, preferably at least 95 wt. %, more preferably at least 98 wt. % of amylopectin. Alternatively, the starch may be an amylose-rich starch, which is starch with less than 10 wt. %, preferably less than 95 wt. % amylopectin. Alternatively, starch of the invention may also be a starch mixture, comprising waxy starch with an amylopectin content of more than 95 wt. %, based on the weight of the starch, and regular starch with an amylopectin content of 70-85 wt. %, based on the weight of the starch. Mixtures of more than two types of starches are also possible. In preferred embodiments, a starch mixture comprises an amylopectin-rich (waxy) starch.

The oxidized carboxylated starch is a starch as defined above in which part of the glucose hydroxyl groups have been oxidized to result in carboxylic acid groups. Thus, the oxidized carboxylated starch is a starch comprising carboxylic acid groups covalently bound to at least some of the (former) glucose units of the carbohydrate polymer. Oxidized carboxylated in the present context thus means that the starch has been oxidized using an oxidizing agent with the result of creating carboxylic acid groups directly on the carbohydrate backbone. The oxidation also results in overall shortening of the starch weight-average molecular weight. The weight average molecular weight of the oxidized carboxylated starch is $0.3-10\times10^6$ Da, preferably $0.5-7.5\times10^6$ Da, more preferably $0.5-5\times10^6$ Da. The weight-average molecular weight of starch can be determined by asymmetric field flow separation, followed by MALLS/RI detection, as described elsewhere.

Oxidized carboxylated starch preferably retains its carboxylated form during the coating process. Thus, oxidized carboxylated starch is preferably not compounded with chemical entities to result in esterification of the carboxyl groups of the oxidized carboxylated starch, e.g. with hydroxyl-bearing compounds, such as for example a glyoxal/urea type resin.

The carboxyl groups of the oxidized starch can be determined titrimetrically, as is known in the art. The oxidized carboxylated starch preferably has more than 0.012 mole/mole carboxylic groups per anhydroglucose unit, more preferably of more than 0.014 mole/mole.

The oxidized carboxylated starch preferably has a charge density of lower than −0.10 μEq/mg dry solids, preferably lower than −0.15 μEq/mg dry solids. The charge density can be determined by titration of the negative charge on the starch polymer with a cationic polymeric titrant.

In a first preferred embodiment, the oxidation to obtain an oxidized carboxylated starch for use in the present invention is carried out using hypochlorite. This results in hypochlorite-oxidized starch. In this embodiment, the oxidation is carried out with an alkali metal hypochlorite as oxidizing agent. Preferably, sodium hypochlorite is used as an oxidizing agent. Alkali metal hypochlorites are relatively cheap and have a relatively large oxidizing power, thus leading to a very efficient and fast oxidizing process.

In a preferred embodiment, the oxidation of starch is performed at pH between 6 and 10, more preferably between 6.5 and 9.5, even more preferably between 7.5 and 9. It has been found that by working at a pH in these ranges particularly small amounts of oxidizing agent suffice in order to obtain an oxidized carboxylated starch having excellent properties.

In order to maintain the pH at a desired value, it may be necessary to add an acid or a base to the reaction mixture. For this purpose, suitable acids and bases may be chosen such that they have substantially no negative effect on the oxidation reaction or on the oxidized starch. Preferably, hydrochloric acid or sodium hydroxide is used.

The temperature at which the starch, in accordance with the invention, is treated with an oxidizing agent is preferably chosen between 20 and 50° C., more preferably between 25 and 40° C.

The oxidation reaction may be carried out as a suspension or solution reaction in water. Preferably, the reaction is carried out as a suspension reaction in water, as this leads to a granular oxidized starch. To this end, the starch to be oxidized is suspended in water in an amount ranging between 0.5 and 1.5 kg of dry starch per liter water.

Optionally, a catalyst or a combination of catalysts may be used in the oxidation reaction. Suitable catalysts include bromide, cobalt, iron, manganese and copper salts. The catalyst or catalysts will be applied in catalytic amounts, which will be no higher than 10 wt. %, with respect to the amount of alkali metal hypochlorite.

Preferably, the reaction product of the above-described oxidation reaction is subjected to an alkaline treatment. This treatment comprises keeping the product for at least 15 minutes at a temperature of 20-50° C. and a pH higher than 10. The alkaline treatment has a beneficial effect on the properties, especially the viscosity stability, of the oxidized carboxylated starch. An oxidized starch according to the invention may be stored at increased temperatures, e.g. 80°

C., for prolonged periods of time without substantially any change in the viscosity of the product being observed.

Preferably, the alkaline treatment lasts at least 30, more preferably at least 60 minutes. Although there is no critical upper limit for the duration of the alkaline treatment, it will usually not be carried out for more than 6 hours in order to prevent that too much of the desired product dissolves in the water. The pH at which the alkaline treatment is carried out is preferably higher than 10.5. Further preferred is that the pH is kept below 12. It has been found that according to these preferred embodiments, an even higher viscosity stability may be achieved.

In a second preferred embodiment, to obtain oxidized carboxylated starch, the oxidation is carried out using hydrogen peroxide in the presence of a manganese complex. The hydrogen peroxide will normally be used in the form of an aqueous solution, as commonly supplied in commerce.

Preferably, the oxidation reaction is performed in a solution, dispersion or suspension of the starch in water, to which the hydrogen peroxide, or an aqueous solution thereof, is added. Preferably, the hydrogen peroxide is added batchwise or dropwise.

The oxidation with hydrogen peroxide comprising a manganese complex may alternatively be carried out in the presence of a homogeneous manganese-based complex coordination catalyst. The homogeneous manganese-based complex coordination catalyst is typically a mononuclear or dinuclear complex of a Mn(III) or Mn(IV) transition metal. It will usually contain at least one organic ligand containing at least three nitrogen atoms that coordinate with the manganese, for example 1,4,7-triazacyclononane (TACN), 1,4,7-trimethyl-1,4,7-triazacyclononane (Me-TACN), 1,5,9-1,5,9-trimethyl-1,5,9-triazacyclododecane (Me-TACD), 2-methyl-1,4,7-triazacyclononane (Me/TACN), 2-methyl-1,4,7-trimethyl-1,4,7-triazacyclononane (Me/Me-TACN), N,N',N"-(2-hyroxyethyl) 1,4,7-triazacyclononane. In a preferred embodiment, the ratio of the manganese atoms to the nitrogen atoms is 1:3.

A suitable catalyst may also contain from 0 to 6 coordinating or bridging groups per manganese atom. When the homogeneous manganese based complex coordination catalyst is a mononuclear complex, coordinating groups are for example selected from —OMe, —O—$CH_2$—$CH_3$, or —O—$CH_2$—$CH_2$—$CH_3$. When the homogeneous based complex coordination catalyst is a dinuclear complex, bridging groups may be selected, among others, from —O—, —O—O—, or —O—CH(Me)-O—. The manganese catalyst may also contain one or more monovalent or multivalent counterions leading to a charge neutrality. The number of such monovalent or multivalent counterions will depend on the charge of the manganese complex which can be 0 or positive. The type of the counterions needed for the charge neutrality of the complex is not critical and the counterions may be selected for example from halides such as chlorides, bromides and iodides, pseudohalides, sulphates, nitrates, methylsulfates, phosphates, acetates, perchlorates, hexafluorophosphates, or tetrafluoro-borates.

A particularly preferred catalyst is compound (I), di-manganese(IV)-tris(mu-oxo)-di(1,4,7-trimethyl-1,4,7-triazacyclononane)-bis(acetate) or [(Me-TACN)$_2$MnIV2(μ-O)3] ($CH_3COO$)$_2$, known as Dragon's blood or Dragon A350.

The manganese catalyst may be present in a total amount of from 10 to 1000 ppm based on the weight of the starch, preferably from 20 to 500 ppm, more preferably from 30 to 200 ppm.

The oxidized carboxylated starch can be a starch without further substitution on the remaining (non-oxidized) glucose groups. Alternatively, part of the non-oxidized glucose hydroxyl groups can be etherified or esterified, resulting in an oxidized carboxylated starch ether or ester. Etherification, resulting in an oxidized carboxylated starch ether, is preferred. In preferred embodiments where the starch is further substituted, such substitution is with known hydrophobic moieties, such as long chain fatty acids (e.g. C6-C20 fatty acids), obtained by reaction with the long chain fatty acid chloride. In case of further substitution, the starch is preferably not compounded with alkyl ketene dimer.

The oxidized carboxylated starch is preferably present in the coating in a quantity of 50-100 wt. %, preferably 50-99 wt. %, more preferably 65-98 wt. %, even more preferably 75-95 wt. %, based on the coating dry weight.

The coating furthermore comprises 0-25 wt. % of a water-soluble starch extender. The starch extender is selected from a crosslinked, cationic polyalkylene amine and a zirconium carbonate.

A crosslinked cationic polyalkylene amine is a polymer comprising di- or triamino alkyl compounds (e.g. diaminopropylamine, diethylene triamine, and the like) and epichlorohydrin. Examples are a) polyamine-epichlorohydrin resin, produced from epichlorohydrin and diaminopropylmethylamine; b) polyamide-epichlorohydrin resin, produced from epichlorohydrin, adipic acid, caprolactam, diethylenetriamine and/or ethylenediamine; c) polyamide-epichlorohydrin resin, produced from adipic acid, diethylenetriamine and epichlorohydrin or a mixture of epichlorohydrin with ammonia; d) polyamide-polyamine-epichlorohydrin resin, produced from epichlorohydrin, adipic acid dimethyl ester and diethylenetriamine; e) polyamide-polyamine-dichloroethane resin, produced from dichloroethane and an amide of adipic acid, caprolactam and diethylenetriamine; f) polyamide-epichlorohydrin resin, produced from epichlorohydrin, diethylenetriamine, adipic acid and ethyleneimine; g) polyamide-epichlorohydrin resin, produced from adipic acid, diethylenetriamine and a mixture of epichlorohydrin and dimethylamine; h) polyamide-epichlorohydrin resin, produced from polyepichlorohydrin, diethylenetriamine and a mixture of epichlorohydrin and dimethylamine; i) polyamide-epichlorohydrin resin, produced from epichlorohydrin, diethylenetriamine, adipic acid, ethyleneimine and polyethyleneglycol; j) polyamide-polyamine-epichlorohydrin resin, produced from epichlorohydrin, adipic acid dimethyl ester, glutaric acid dimethyl ester and diethylenetriamine; k) Polyamide-polyamine-dichloroethane resin, produced from adipic acid, diethylenetriamine and 1,2-dichloroethane; l) polyamide-polyamine-dichloroethane resin, produced from adipic acid, diethylenetriamine, and a mixture of ethylenediamine, diethylenetriamine, triethylenetetramine, tetraethylenepentamine, pentaethylenehexamine, aminomethylpiperazine and 1,2-dichloroethane; m) polyamine-dichloroethane resin, produced from bis-(3-aminopropyl)-methylamine and 1,2-dichloroethane; n) polyamideamine-polyetheramine-epichlorohydrin resin, produced from diethylenetriamine, caprolactam, adipic acid, polyethyleneglycol and epichlorohydrin; o) polyamidoamine-ethyleneimine resin, produced from adipic acid, a mixture of ethylenediamine and N-(2-aminoethyl)-1,3-propylenediamine, N,N'-[bis-(3-aminopropyl)]-1,2-ethylenediamine, ethyleneimine, epichlorohydrin and polyethyleneglycol. All crosslinked cationic polyalkylene amines a)-o) are well known in the art.

The crosslinked, cationic polyalkylene amine is preferably a polyamine epichlorohydrin resin, a polyamide-epichlorohydrin resin, or a polyamide-polyamine-epichlorohydrin resin. The polyamine epichlorohydrin resins, polyamide-epichlorohydrin resins and polyamide-polyamine epichlorohydrin resins are collectively referred to as PAE.

A PAE resin is an electrolyte which can among others be formed by the reaction between adipic acid and diethylene triamine, and subsequent derivatization of the resulting copolymer with epichlorohydrin, as is known in the art. PAE resins are well-known in the art, and cationic in nature due to the presence of azetidinium groups in the backbone.

Preferably, a PAE resin contains low amounts of dichloropropanol (DCP) and monochloropropanediol (MCPD). Preferably the DCP content is below 1000 ppm, more preferably below 500 ppm, more preferably below 100 ppm and most preferably below 5 ppm.

A zirconium carbonate as used in the present invention is a water soluble zirconium carbonate complex, such as potassium zirconium carbonate or ammonium zirconium carbonate. Zirconium carbonates, and their complexes, are well-known in the art, and can be readily obtained by the skilled person.

Both crosslinked cationic polyalkylene amines as well as zirconium carbonates are characterized by their cationic nature. A crosslinked cationic polyalkylene amine, preferably PAE resin, is cationic in nature due to the presence of azetidinium groups on the backbone, whereas the valence charge of zirconium is plus four.

Both crosslinked cationic polyalkylene amines and zirconium carbonates are known to improve the durability of starch-based coatings, but it has not previously been known that these compounds are capable of improving the oil- and grease resistance of a cellulosic material when combined with an oxidized carboxylated starch as defined above in a coating on a cellulosic material. This capability of crosslinked cationic polyalkylene amines and zirconium carbonates contrasts with other known durability-improving agents such as e.g. glyoxal, glyoxal urea or urea-formaldehyde resins, which have been found not to display the capability to improve the oil- and grease resistance of a cellulosic material.

The quantity of the water-soluble starch extender in the coating is 0-25 wt. %, based on the coating dry weight. In one embodiment, the quantity of the water-soluble starch extender in the coating is 1-25 wt. %, preferably 1 to 10 wt. %, more preferably 2 to 7.5 wt. %, most preferably 2.5 to 6 wt. %, based on the coating dry weight. In another embodiment, the quantity of the water-soluble starch extender in the coating is 0-0.99 wt. %, based on the coating dry weight.

Optionally, the coating further comprises a modified or non-modified non-carboxylated starch. A non-carboxylated starch in this context is a starch which has not been oxidized to result in carboxylic acid groups on the (former) glucose units of the polysaccharide backbone. Non-carboxylated in the present context means that the starch has not been oxidized with the result of creating carboxylic acid groups directly on the carbohydrate backbone. In some embodiments however, the non-carboxylated starch may be substituted with carboxylic acid groups through a spacer which is connected to a hydroxyl moiety on a glucose unit through an ether or ester bond, as in modified starch which is substituted with e.g. a dicarboxylic acid or an anhydride.

Preferably, the non-carboxylated starch is a modified starch. In this embodiment, the coating comprises a starch blend of two different types of starch, the first starch type a carboxylated and potentially modified starch, and the second starch type a (modified or unmodified), non-carboxylated starch. Preferred types of non-carboxylated starch in this blend can be a starch ester, such as a starch acetate or a starch octenyl succinate, a starch ether such as hydroxypropyl starch, hydroxyethyl starch, carboxymethyl starch, starch treated with 3-chloro-2-hydroxypropyl trimethylammonium chloride (2-hydroxypropyl trimethylammonium chloride starch ether) and starch treated with 3-chloro-2-hydroxypropyl dimethylalkyl ammonium chloride (2-hydroxypropyl dimethyl alkyl ammonium chloride starch ether). A much preferred type of non-carboxylated starch in the blend is starch octenyl succinate.

The non-carboxylated starch may be present in a quantity of 0 to 50%, preferably 5 to 40%, more preferably 7.5 to 20%, based on the dry weight of the coating. An oxidized carboxylated starch can be blended in a ratio of 2-50 parts of oxidized carboxylated starch to 1 part of non-carboxylated starch, based on dry weight, preferably in the ratio 5-40 to 1, more preferably in the ratio 7.5-20 to 1.

In a much preferred embodiment, a blend of a non-carboxylated starch and an oxidized carboxylated starch is a blend of a starch octenyl succinate, preferably a waxy potato starch octenyl succinate, such as for example ref 6, and an oxidized carboxylated starch as defined above, preferably an oxidized carboxylated waxy potato starch, such as for example starch B. In much preferred embodiments, the weight ratio between the oxidized carboxylated starch and the starch octenyl succinate is 7-11 to 1, preferably 8-10 to 1, optimally about 9 to 1. An advantage of such a blend is that this blend, in combination with the starch extender, results in a heat-stable composition, i.e. a coating of this composition applied on paper or board retains its resistance against the penetration of oil or grease at high temperatures as well.

In other, much preferred embodiments, the coating comprises the oxidized carboxylated starch as the only starch component. In this embodiment, there are no other starch types present in the coating, and the coating does not comprise non-carboxylated starch.

Further other components can be used to improve the oil and grease resistance of the composition. Pigments can be used to further improve the oil and grease resistance, especially the addition of platy kaolin types may improve the oil and grease resistance of the composition of the invention. Synthetic emulsion polymers such as styrene butadiene copolymer emulsions, styrene acrylate copolymer emulsions or polyacrylate emulsions can optionally be added to the coating formulation of the invention to improve the flexibility of the coating layer. Addition of plasticizers can be used to improve the flexibility of the coating. Other components that can be present in the coating of the invention are waxes or emulsions such as AKD or ASA to reduce the water absorption of the cellulosic material. The coating may further comprise pH regulating additives such as a strong or soft acid or base, such as citric acid, acetic acid, ammonia, diluted hydrochloric acid, sulfuric acid or potassium or sodium hydroxide. The composition may further comprise a stearic acid salt or glycerol monostearate.

The invention furthermore discloses use of a coating as defined above for improving the oil and grease resistance of a cellulosic material, preferably a material having a porosity before coating of at least 250 s/100 ml, more preferably at least 500 s/100 ml.

The invention also discloses a method to improve the oil and grease resistance of a cellulosic material, comprising providing a cellulosic material, coating said material on at least one side with a homogenous aqueous composition comprising an oxidized carboxylated starch and optionally a starch extender, selected from a crosslinked cationic polyalkylene amine and a zirconium carbonate, and drying the cellulosic material. The cellulosic material, the oxidized carboxylated starch and the starch extender are as defined above. The cellulosic material preferably has a porosity prior to coating of at least 250 s/100 ml, more preferably at least 500 s/100 ml. This results in a cellulosic material provided with a coating as defined in claim 1, which preferably has a porosity of more than 250 s/100 ml, more preferably more than 500 s/100 ml, even more preferably more than 800 s/100 ml, and most preferably more than 1000 s/100 ml.

The coating is applied to the cellulosic material by providing a homogenous aqueous solution comprising the oxidized carboxylated starch and optionally the starch extender. The homogenous aqueous solution is referred to as the "coating solution". The coating solution can be prepared by combining the oxidized carboxylated starch and the optional starch extender, as well as optionally other components in any order, and homogenizing the solution, optionally under heating. Methods to obtain a homogenous aqueous solution comprising the oxidized carboxylated starch and the starch extender can readily be envisioned by the skilled person.

In the coating solution, the oxidized carboxylated starch is preferably present in a quantity of 0.5-25 wt. %, preferably 1-20 wt. %, more preferably 2-17.5 wt. %. Furthermore, the starch extender is present in the coating solution in a quantity of 0-15 g per 100 g oxidized carboxylated starch, preferably 2-15 g per 100 g oxidized carboxylated starch, preferably 3-10 g per 100 g oxidized carboxylated starch. Alternatively, the starch extender can be present in the coating solution in a quantity of 0-3 wt. %, preferably 0.01-2.5 wt. %.

The coating solution can be applied by well-known methods for applying liquid compositions to cellulosic materials. The coating solution can be applied to one side of the cellulosic material, but may also be applied to both sides of the cellulosic material. For example, the composition can be applied by a horizontal size press, a declined size press, a film press, a gate roll coater, a rod coater, spray coater, curtain coater, air knife coater, a metering bar or a bent blade coater, a stiff blade coater, a soft tip blade coater.

After application, the cellulosic material must be dried in order to obtain the cellulosic material of the invention. Drying can be achieved by any means known in the art of drying cellulosic material, such as air drying, potentially under heating, vacuum drying, IR drying, or roll drying. This results in a cellulosic material with improved oil- and grease resistance.

For the purpose of clarity and a concise description features are described herein as part of the same or separate embodiments, however, it will be appreciated that the scope of the invention may include embodiments having combinations of all or some of the features described. The invention will now be illustrated by the following, non-limiting examples.

EXAMPLES

Starch Types

Starch A 1.0 kg of regular potato starch (0.81 kg dry matter, food grade potato starch from AVEBE; amylopectin content 81%) was suspended in 1.0 kg of water. The temperature of the suspension was increased to 35° C. 167 ml of a sodium hypochlorite solution containing 179 g/liter of active chlorine was added while maintaining the pH at 8.2 by the addition of a 4.4 wt. % sodium hydroxide solution. Once the reaction was complete, i.e. no chlorine was detectable with potassium iodide-starch paper, the pH was increased to 10.5 by the addition of a 4.4 wt. % sodium hydroxide solution. After one hour of alkaline post-treatment 5 ml sodium hypochlorite solution was added for decoloration. The reaction mixture was neutralized to pH 5.5 by the addition of 10 N $H_2SO_4$, whereupon the product was dewatered and washed before drying.

Starch B 1.0 kg of amylopectin potato starch (0.81 kg dry matter, Eliane® potato starch from AVEBE; amylopectin content >98%) was suspended in 1.0 kg of water. The temperature of the suspension was increased to 35° C. The pH was set at 9.0 by the addition of a 4.4 wt. % sodium hydroxide solution. 63.7 ml of a sodium hypochlorite solution containing 179 g/liter of active chlorine was added. During the oxidation the pH was maintained at 9.0 by the addition of a 4.4 wt. % sodium hydroxide solution. Once the reaction was complete, i.e. no chlorine was detectable with potassium iodide-starch paper, the pH was increased to 10.5 by the addition of a 4.4 wt. % sodium hydroxide solution. After one hour of alkaline post-treatment 5 ml sodium hypochlorite solution was added for decoloration. The reaction mixture was neutralized to pH 5.5 by the addition of 10 N $H_2SO_4$, whereupon the product was dewatered and washed before drying.

Starch C

For starch C a mixture of 0.5 kg regular potato starch (0.41 kg dry matter, food grade potato starch from AVEBE; amylopectin content 81%) and 0.5 kg of amylopectin potato starch (0.41 kg dry matter, Eliane® potato starch from AVEBE; amylopectin content >98%) was suspended in 1.0 kg of water. The temperature of the suspension was increased to 35° C. The pH was set at 9.0 by the addition of a 4.4 wt. % sodium hydroxide solution. 48.0 ml of a sodium hypochlorite solution containing 179 g/liter of active chlorine was added. During the oxidation the pH was maintained at 9.0 by the addition of a 4.4 wt. % sodium hydroxide solution. Once the reaction was complete, i.e. no chlorine was detectable with potassium iodide-starch paper, the pH was increased to 10.5 by the addition of a 4.4 wt. % sodium hydroxide solution. After one hour of alkaline post-treatment 5 ml sodium hypochlorite solution was added for decoloration. The reaction mixture was neutralized to pH 5.5 by the addition of 10 N $H_2SO_4$, whereupon the product was dewatered and washed before drying.

Starch D 1.0 kg of regular potato starch (0.81 kg dry matter, food grade potato starch from AVEBE; amylopectin content 81%) was suspended in 1.0 kg of water in a closed double jacket reaction vessel. The temperature of the suspension was increased to 35° C. The pH was set at 10.0 by the addition of a 4.4 wt. % sodium hydroxide solution. 100 ml of a sodium hypochlorite solution containing 170 g/liter of active chlorine was added while maintaining the pH at 10 by the addition of a 4.4 wt. % sodium hydroxide solution. Once the reaction was complete, i.e. no chlorine was detectable with potassium iodide-starch paper, the pH was increased to 11.4 by the addition of a 4.4 wt. % sodium hydroxide solution. Then 50 g ethylene oxide was added and the reaction mixture was stirred during 16 hours. 5 ml sodium hypochlorite solution was added for decoloration. The reaction mixture was neutralized to pH 5 by the addition of 10 N $H_2SO_4$, whereupon the product was dewatered and washed before drying.

Starch E

Starch E was prepared similarly as starch B, but now 29.0 ml of a sodium hypochlorite solution containing 179 g/liter of active chlorine was added.

Starch F 1.0 kg of regular potato starch (0.81 kg dry matter, food grade potato starch from AVEBE; amylopectin content 81%) was suspended in 1.0 kg of water. The temperature of the suspension was increased to 35° C. 105 ml of a sodium hypochlorite solution containing 170 g/liter of active chlorine was added while maintaining the pH at 9.0 by the addition of a 4.4 wt. % sodium hydroxide solution. Once the reaction was complete, i.e. no chlorine was detectable with potassium iodide-starch paper, the pH was increased to 10.5 by the addition of a 4.4 wt. % sodium hydroxide solution. After one hour of alkaline post-treatment 5 ml sodium hypochlorite solution was added for decoloration. Next, the suspension is neutralized to pH 8.5 and 18.4 mL acetic anhydride is added dropwise to the suspension while the suspension is kept at pH 8.5 using 4.4% (w/w) sodium hydroxide solution. After all acetic anhydride has been added the suspension is stirred for an additional 10 minutes. Next, the suspension is neutralized to pH 5, filtered and washed before drying.

Reference Starch 1

An etherified thinned corn starch obtained from Cargill, obtainable under the trade name C*Film 05733.

Reference Starch 2

A corn starch dextrin obtained from Cargill, obtainable under the trade name C*Film 07311.

Reference Starch 3

Reference starch 3 was prepared similar to starch A, but now 188 mL a sodium hypochlorite solution containing 170 g/liter of active chlorine was added, while maintaining the pH at 7.5.

Reference Starch 4

1.0 kg of amylopectin potato starch (0.81 kg dry matter, Eliane® potato starch from AVEBE; amylopectin content >98%) was suspended in tap water to a 39% w/w suspension. The temperature of the suspension is increased to 45° C. 100 ml 10 N $H_2SO_4$ (=38%) was added to the suspension. The suspensions was stirred during 17 hours at 45° C. After 17 hours the suspension is neutralized to pH 6.0 by the addition of a 4.4 wt. % sodium hydroxide solution whereupon the product was dewatered and washed before drying.

Reference Starch 5

1.86 kg dry waxy corn starch (87% dry matter, Merizet 300, Tate & Lyle) was suspended in tap water to a 39% w/w suspension. The temperature of the suspension is increased to 45° C. 180 nil 10 N $H_2SO_4$ (=38%) was added to the suspension. The suspensions was stirred during 17 hours at 45° C. After 17 hours stirring, the suspension is dewatered over a Buchner funnel and washed with 10 L tap water.

Reference Starch 6

A waxy potato starch esterified with octenyl succinic acid obtained from Avebe and commercially available under the trade name Eliane MC160.

Reference Starch 7

Regular potato starch (0.81 kg dry matter, food grade potato starch from AVEBE) was suspended in 2 L tapwater to obtain a potato starch slurry with a dry content of 21%. 2.3% $K_2S_2O_8$ (w/w) was added. The starch suspension was jet cooked using a jet-cooker at a temperature of 125° C. The starch solids were measured and the solution was diluted to 17.5%. The pH was adjusted to 6-7 using diluted NaOH and stored at 50° C. prior to addition of the different additives.

Reference Starch 8

Reference starch 5 (0.81 kg dry matter) was suspended in tap water to a 39% w/w solution. The temperature is set on 25° C. and the pH at 8.5 with 4.4 wt. % NaOH. Next, 25.2 g octenyl succinate is added to the suspension while maintaining the pH at 8.5 using 4.4 wt. % NaOH. After the consumption of NaOH has stopped, the suspension is neutralized to pH 5.5 using 10 N $H_2SO_4$, filtered and washed before drying.

Properties of all starch types are summarized in table 1.

TABLE 1

| | Starch type | Charge density [uEq/mg d.s.] | MW*10e6 [g/mol] |
|---|---|---|---|
| Ref 1 | Corn starch, thinned, etherified | −0.038 | 13 |
| Ref 2 | Corn starch dextrin | −0.03 | 0.16 |
| Ref 3 | Potato starch oxidized-carboxylated | −0.33 | 0.26 |
| Ref 4 | Waxy potato starch, thinned | −0.055 | 1.5 |
| Ref 5 | Waxy corn starch, thinned | −0.01 | 5.6 |
| Ref 6 | Waxy potato starch, octenyl succinate | −0.185 | >>20 |
| Ref 7 | Potato starch, oxidized non-carboxylated | −0.07 | 0.51 |
| Ref 8 | Waxy corn starch, thinned, octenyl succinate | −0.165 | 5.6 |
| A | Potato starch, oxidized-carboxylated | −0.39 | 0.55 |
| B | Waxy potato starch, oxidized-carboxylated | −0.16 | 2.8 |
| C | Mixture of potato and waxy potato starch, oxidized-carboxylated | −0.18 | 1.6 |
| D | Potato starch, oxidized-carboxylated, hydroxypropylether | −0.16 | 3.5 |
| E | Waxy potato starch, oxidized-carboxylated | −0.13 | 6.6 |
| F | Potato starch, oxidized-carboxylated, acetylated | −0.21 | 1.7 |

Starch Extenders

Cartabond EZI-DP is ammonium zirconium carbonate solution from Archroma. Nopcote KZC is a potassium zirconium carbonate solution from Nopco. Giluton 3640 is a crosslinked cationic polyalkylene amine, available as a polyamidoamine epichlorohydrin resin (PAE) from Kurita. Polycup 2000 is a polyamide epichlorohydrin resin (PAE) from Solenis. The amounts of the reagents are added calculated as dry on dry starch. The pH of the coating composition has been adapted according to the suppliers specifications using diluted hydrochloric acid (1M) or diluted sodium hydroxide (5%).

Other Compounds

Solvera PT5045PG is (per)fluoropolyether from Solvay Solexis with a dry solids content of about 20%. Cartabond TSI-NG is a glyoxal based resin from Archroma. Cartabond EPI is glyoxal based resin from Archroma. Glyoxal P is a glyoxal solution from BASF. Urecol SMV is an urea-formaldehyde resin from BASF. Aquapel F220 is an AKD emulsion from Solenis.

Methodology

Starch Dissolution

Starch is added in cold water in a tank, equipped with a suitable stirrer. The obtained starch slurry is then heated in a water bath with well-dispersed live steam to a temperature of 95° C. This temperature was maintained for 20 minutes. The starch solution is stored at 50° C. before use.

Preparation of the Coating Solution

The starch solutions have been diluted after cooking in tap water to 20% solids using hot water of about 60° C. The starch extenders were mixed with additional water and added under severe stirring to obtain the desired aqueous composition with a final total dry solids. If required, the pH of the aqueous composition can be adjusted with either diluted sodium hydroxide or hydrochloric acid. The starch extenders and other additives are added as parts dry calculated on 100 parts dry starch.

Oil and Grease Resistance ("OGR", ASTM F119)

OGR was also measured using an adapted version of ASTM F119. Paper samples with a width of 5.5 cm and a length of 21 cm are cut in machine direction. TLC plates (Merck) with a plastic backing are cut into strips of 5 cm width and 20 cm length. Place the TLC strip on a glass plate with the silica layer on top. The paper sample is placed on top of the TLC strip. Record the upside of the paper and mark it as either coded (c.s) or uncoded side (u.s). Place two cotton flannel disks on top of each other at the center and at the two ends of the test specimen. Add drops of standard olive oil (Albert Heijn, traditioneel) with a volume of 200 μL to the cotton disks. Place the 50 g weights on the oiled patches. Put the test specimen in a pre-heated oven at 40° C. and note the time. At periodic intervals, depending on the length of time to anticipated failure, take the glass plate with the test specimen from the oven and place the glass plate on a light table. Lift the 50 g weight, cotton disk, and the test specimen from the TLC plate and observe if any traces of spots are visible on the TLC plate at the position of the weight. If no failure is visible, replace the assembly in the oven. The specimen is marked as failed once oil transfer has occurred at all three spots of the test specimen. The time recorded is the first observation when visible traces of oil on the TLC plate are observed at all three spots. The following time intervals are used (hours). When failure occurs within 16 hours: t=1, 2, 3, 4, 6, 8, 24. When failure occurs after 16 hours: t=16, 20, 24, 40, 48, 64, 72. Illuminated backing light is used to visualize the oil present on the TLC-plate.

Hot Grease Test

This test is similar to the test described as "Oil and grease resistance (ASTM F119); the differences suffice to establish the heat resistance of the oil- and grease resistant coating.

The hot grease test is different from ASTM F119 in that in the hot grease test, paper strips are placed on standard 80 gsm Woodfree printing paper placed on a glass plate. Two cotton flannel disks are placed on top of each other at the center and at the two ends of the test specimen. Drops of clarified butter at 50° C. (Albert Heijn, salted butter) with a volume of 200 μL are added to the cotton disks. Subsequently, 50 g weights are placed on the oiled patches. The test specimen is placed in a pre-heated oven at 180° C. After 30 minutes, the glass plate with the test specimen is taken from the oven and the 50 g weight, cotton disks, and the test specimen removed from the printing paper. The number of stains visible at the position of the weight in the printing paper is counted. The quantity of spots visible at the three positions is summed to give the test result. The paper with the lowest quantity of stains has the best hot grease resistance.

Brookfield Viscosity of a Starch Solution

Starch viscosity is measured in a 300 mL glass beaker with a Brookfield type LVF at 60 rpm and 50° C. using the appropriate spindle. The value is recorded when the viscosity is stable or after 60 s.

Weight-Average Molecular Weight ("MW")

Prior to dissolution, a specific amount of a starch sample (powder (as is)) was weighed into a glass vial (20 ml). Subsequently 20 ml eluent (50 mM $NaNO_3$) was added to obtain a concentration of 2 mg/ml. The vial was capped with an aluminum/silicone septum and fitted into a heating block. The vail was heated under continuous stirring during 60 minutes at 130° C. After cooling to room temperature some of the obtained solution was collected with a syringe (5 ml), and this quantity was subsequently filtered over a 5.0 μm cellulose acetate filter into a sample vial (1.5 ml; septum/screw cap).

Molecular weight (MW) of the samples was determined after separation by asymmetric field flow and detected with MALLS/RI detector. The MW and the molecular mass distribution (MMD) were determined by means of aF4/MALLS/RI. The aF4 system consisted of a Dionex HPLC system (quaternary pump, auto sampler including a 250 μl injection loop), thermostatic column compartment, light-scattering (LS) detector (Dawn Heleos II; Wyatt), and a refractive index (RI) detector (T-rex; Wyatt). The scattered light was detected at multiple angles (18) ranging from 13° to 158°. The multi angle laser light scattering (MALLS) was serially connected with the concentration (RI) detector. A sample is fractionated via a Frit Inlet channel with a permeable wall having a 5 kDa pore size. A pullulan DIN standard (50 kDa; 2 mg/ml) was used for normalization of the MALLS, and alignment of the MALLS and RI detector (correction for inter detector delay volume and bandbroading). Samples were stored in the auto sampler at 25° C. to be processed automatically in a sequence overnight. Elution of the samples was carried out with an aqueous eluent (50 mM $NaNO_3$) at a specific flow regime at 25° C. The sample volume was set at 50 μl based on the average concentration of all samples. The data acquired during every run were collected and afterwards evaluated with the ASTRA software (version 6.1.2.84).

Charge Density ("CD")

A beaker of 1 L is filled with approximately 500 ml demineralized water and 25 mg minusil (U.S. Silica Company). 1 mL of an exactly 1% starch solution is added into the beaker while stirring. The zetapotential of the starch solution is measured using a zetasizer (Malvern Nano Z). The starch solution is titrated with a 1 mM solution of methylglycol chitosan (Sigma Aldrich). After each addition of titrant the zetapotential is measured and the titration is continued until the equivalence point. The charge density of the starch can be calculated as mmol titrant/mg dry starch equals μEq/mg dry starch. In the present context, the charge density refers to the charge density as obtained by starch oxidation.

Surface Size Starch Determination

Weigh 1.050 g of paper and put into a blender. Add 100 ml water and grind the paper to pulp. Add 25 g pulp into a plastic bottle and fill up to 97.5 g with hot tap water. Add 2.5 ml acetate buffer of pH 4.6 and 0.1 ml of a 1:1 mixture alfa-amylase and amyloglucosidase (both from Megazyme). Allow the starch to be converted into D-glucose by storing the bottle during 2 hours at 60° C. The concentration D-glucose was then quantitatively determined using the D-glucose assay kit from Megazyme (K-GLUHK) and finally recalculated to the starch content in the paper as g/m$^2$.

Take an untreated paper sample to measure the starch content of the blank. The surface size starch is the amount of starch present in the coated paper minus the amount of starch present in the blank. The amount of surface size starch is expressed as the total amount of surface size starch present on one side for single-side coated paper, or on both sides for double-sided coated paper, in g/m$^2$. It represents the total quantity of coating applied to the cellulosic material.

Gurley Porosity

Porosity of the paper was determined according to Gurley (NEN ISO 5636-5) using a Densometer from Lorentzen and Wettre (Sweden) and expressed as the time in seconds for 100 ml of air to pass a paper sheet. The average of three measurements per paper sheet is shown. The porosity can be determined before or after coating; unless otherwise mentioned, the Gurley porosity is reported after coating.

Application of the Composition to Paper

The starch solutions (concentration by weight of starch as indicated in the examples; temperature 50° C.) were applied to both sides of the base paper (e.g. Base paper 1: Pfleiderer Papier, 36 g/m$^2$ OGR base paper) using a horizontal size press (type T.H. Dixon; model 160-B; roll hardness 80 shore). The machine speed of the Dixon was 50 m/min and the line pressure was 7 kg/cm. The surface sized paper was thereafter dried to less than 5% by weight of moisture. The paper samples obtained were conditioned at 23° C. and 50% relative humidity for at least 48 hours before testing. The outside of the base paper is marked as the coded side (c.s.).

Example 1

Improving Oil- and Grease Resistance

Papers were coated with compositions as shown in table 2.

TABLE 2

| Starch | | solids | Ref | | | | | | | |
|---|---|---|---|---|---|---|---|---|---|---|
| B | | wt. % | 7 | 15 | 15 | 15 | 15 | 15 | 15 | |
| Additive | Type | | | 0 | | | | | | |
| Solvera PT5045 PG | Fluoro chem. | Parts | 6 | | | | | | | |
| Giluton 3640 | PAE | Parts | | | 5 | | | | | |
| Cartabond EZI | Zr | Parts | | | | 5 | | | | |
| Cartabond TSI | glyoxal resin | Parts | | | | | 5 | | | |
| Glyoxal P | glyoxal | Parts | | | | | | 5 | | |
| Urecoll SMV | U.F. resin | Parts | | | | | | | 5 | |
| Cartabond EPI | glyoxal resin | Parts | | | | | | | | 5 |
| Viscosity | | | 9.5 | 37 | 103 | 49 | 74.8 | 185 | 38.4 | 70 |
| pH | | | 7.8 | 7.3 | 7.0 | 8.4 | 6.5 | 6.6 | 7.2 | 6.5 |
| Surface size starch | | g/m$^2$ | 0.82 | 2.33 | 2.92 | 2.64 | 2.58 | 3.37 | 2.19 | 2.51 |
| Fluorchem | | g/m$^2$ | 0.049 | No | No | No | No | No | No | No |
| ASTM F119 | c.s. | hour | 20 | 20 | 72 | 48 | 16 | 20 | 20 | 16 |

The examples from Table 2 show that the penetration of oil through a paper as measured with the ASTM F119 test is similar for a coating based on an oxidized carboxylated starch, as for a coating comprising fluorochemical. In addition, the penetration of oil through a paper is significantly retarded after coating the paper with a solution of starch B further comprising a starch extender. Using a crosslinked cationic polyalkylene amine such as a polyamidoamine epichlorohydrin resin, or a zirconium carbonate retards the penetration of oil through the paper significantly. This effect is not observed with other compounds recommended in starch-based coatings. Table 2 also shows that the oil and grease resistance of compositions comprising both oxidized carboxylated starch and a starch extender is better than using a composition based on fluorochemicals.

Example 2

Defining the Optimal Starch Type

Papers were coated with compositions as shown in table 3.

TABLE 3

| Starch type | MW | CD | solids | | | | | | | | |
|---|---|---|---|---|---|---|---|---|---|---|---|
| Ref 3 | 0.26 | −0.33 | % | 17.5 | 17.5 | | | | | | |
| A | 0.55 | −0.39 | % | | | 17.5 | 17.5 | | | | |
| B | 2.8 | −0.16 | % | | | | | 15 | 15 | | |
| C | 1.6 | −0.178 | % | | | | | | | 15 | 15 |
| Additive | Type | | | | | | | | | | |
| Cartabond EZI | Zr | | parts | 0 | 5 | 0 | 5 | 0 | 5 | 0 | 5 |
| Viscosity | | | mPa | 13.8 | 16.3 | 23 | 27 | 37.4 | 49 | 41.7 | 50.1 |
| pH | | | | 6.9 | 8.7 | 6.8 | 8.4 | 7.3 | 8.4 | 7 | 8.2 |
| Surface size starch | | | $g/m^2$ | 2.26 | 2.29 | 2.35 | 2.63 | 2.33 | 2.64 | 2.35 | 2.50 |
| ASTM F119 c.s. | | | hour | 6 | 4 | 24 | 72 | 20 | 48 | 20 | 44 |

It follows from table 3 that the improvement in oil and grease resistance depends on the molecular weight. The oil- and grease resistance of oxidized carboxylated starches as defined is better than the oil- and grease resistance of starches with a molecular weight outside the claimed range. In addition, the oil- and grease resistance of starches with a molecular weight higher than 300.000 g/mol is improved by combination with a zirconium carbonate. The oil- and grease resistance of reference starch 3, which has a lower molecular weight, does not improve in combination with a zirconium carbonate. Similar results were obtained using a PAE resin.

Papers were also coated with compositions as shown in table 4.

TABLE 4

| Starch type | MW | C.D. | solids | | | | | | |
|---|---|---|---|---|---|---|---|---|---|
| B | 2.8 | −0.163 | % | 15 | 15 | | | | |
| Ref 4 | 1.5 | −0.055 | % | | | 15 | 15 | | |
| Ref 5 | 5.6 | −0.010 | % | | | | | 15 | 15 |
| Additive | Type | | | | | | | | |
| Polycup 2000 | PAE | | parts | 0 | 5 | 0 | 5 | 0 | 5 |
| Viscosity | | | mPas | 37.4 | 79.2 | 27.2 | 41.5 | 26 | 36.1 |
| pH | | | | 7.3 | 7.3 | 6.7 | 7.3 | 8.2 | 7.2 |
| Surface size starch | | | $g/m^2$ | 2.33 | 2.69 | 2.01 | 2.12 | 2.01 | 2.18 |
| ASTM F119 c.s. | | | Hours | 20 | 40 | 8 | 20 | 2 | 6 |

As shown in Table 4, starches within the optimal molecular weight range and also having a charge density of lower than −0.10 μEq/mg dry solids perform best in improving the oil and grease resistance. This is all the more so in combination with a crosslinked cationic polyalkylene amine such as a polyamide epichlorohydrin resin. Similar results were obtained using a zirconium carbonate.

Example 3

Further Modification of Starch

Papers were also coated with compositions as shown in table 5.

TABLE 5

| Starch type | MW | C.D. | solids | | | | | | |
|---|---|---|---|---|---|---|---|---|---|
| B | 2.8 | −0.163 | % | 15 | 15 | | | | |
| D | 3.5 | −0.155 | % | | | 15 | 15 | | |
| F | 1.7 | −0.212 | % | | | | | 15 | |
| Mixture of B and F (9/1 w/w) | | | % | | | | | | 15 |

TABLE 5-continued

| Starch type | MW | C.D. | solids | | | | | | | |
|---|---|---|---|---|---|---|---|---|---|---|
| Blend of B and Ref 6 (9/1 w/w) | | | % | | | | | | | 15 |
| Additive | Type | | | 0 | | 0 | | | | |
| Cartabond EZI | Zr | | Parts | | 5 | | 5 | | | |
| Giluton 3640 | PAE | | Parts | | | | | 5 | 5 | 5 |
| Viscosity | | | mPAs | 47 | 49 | 46 | 61 | 88 | 60 | 136 |
| pH | | | | 7.3 | 8.4 | 7.3 | 8.4 | 6.9 | 6.8 | 7 |
| Surface size starch | | | $g/m^2$ | 2.33 | 2.64 | 2.29 | 2.43 | 2.67 | 2.62 | 3.35 |
| ASTM F119 c.s. | | | hours | 20 | 48 | 40 | >72 | 48 | 48 | >72 |

Table 5 shows that oxidized-carboxylated potato starch can be further modified and still show the improvement in oil and grease resistance, in particular when combined with a starch extender. The oxidized-carboxylated potato starch can be further modified by any modification known in the industry, for example, but not limited to esterification with vinyl acetate, acetic anhydride or any other anyhride leading to a starch ester bond, or etherification with ethylene oxide, propylene oxide or chloro-hydroxy propyl trimethylammonium chloride or any other reagent leading to a starch ether bond. Starch B is oxidized carboxylated potato starch without further modification. Starch D shows the good oil and grease resistance when the oxidized carboxylated starch was additionally etherified with ethylene oxide. Starch F is an oxidized-carboxylated potato starch which was additionally esterified with acetic acid anhydride.

The oxidized-carboxylated starch may also be combined with other, starch types to impart oil and grease resistance. The starches which are combined can be oxidized-carboxylated according to the invention or other, non-carboxylated starch types. Table 5 shows a composition comprising a mixture of Starch B and Starch F in the weight ratio 9 to 1 in combination with a starch extender. Another example shows a composition comprising a blend of starch B and reference 6 in a weight ratio of 9 to 1 in combination with a starch extender. The starch of the invention can be blended with a second type of starch in the ratio 2 to 50 parts on dry weight, preferably in the ratio 5 to 40 parts, more preferably in the ratio 7.5 to 20 parts.

Example 4

Further Modification of Starch

Papers were also coated with compositions as shown in table 6.

TABLE 6

| Starch type | MW | C.D. | solids | | | | | | |
|---|---|---|---|---|---|---|---|---|---|
| B | 2.8 | −0.163 | | 15 | 15 | | | | |
| Ref 2 | 0.16 | −0.03 | | | | 17.5 | 17.5 | | |
| Ref 1 | 13 | −0.038 | | | | | | 12.5 | 12.5 |
| Additive | Type | | | | | | | | |
| Cartabond EZI | Zr | | Parts | 0 | 5 | 0 | 5 | 0 | 5 |
| Viscosity | | | mPas | 47 | 49 | 21 | 22 | 72.8 | 95.4 |
| pH | | | | 7.3 | 8.4 | 6.9 | 8.4 | 8 | 8.4 |
| Surface size starch | | | $g/m^2$ | 2.33 | 2.64 | 2.01 | 2.21 | 1.77 | 1.81 |
| ASTM F119 e.s. | | | m.d. | 20 | 48 | 3 | 8 | 3 | 8 |

Table 6 shows that non carboxylated starch derivatives have a much lower oil and grease resistance. The starch Ref 1 is additionally etherified. The performance improves slightly when using a starch extender, but oxidized carboxylated starch types are far superior, and even more so in combination with a starch extender.

Example 5

The Starch Extender

Papers were also coated with compositions as shown in table 7.

TABLE 7

| Starch type | MW | C.D. | solids | | | | | | | | |
|---|---|---|---|---|---|---|---|---|---|---|---|
| B | 2.8 | −0.163 | 0.2 | 15 | 15 | 15 | 15 | 15 | 15 | 15 | 15 |
| Additive | | Type | | | | | | | | | |
| Giluton 3640 | | PAE | Parts | | 2.5 | 5 | | | | | |
| Polyeup 2000 | | PAE | Parts | | | | 5 | 10 | | | |
| Cartabond EZI | | Zr | Parts | | | | | | 2.5 | 5 | |

TABLE 7-continued

| Starch type | MW | C.D. | solids | | | | | | | | |
|---|---|---|---|---|---|---|---|---|---|---|---|
| Nopcote KZC | | Zr | Parts | | | | | | | | 5 |
| Viscosity [mPas] | | | | 37 | 49 | 103 | 79.2 | 71 | 66.5 | 49 | 70 |
| pH | | | | 7.3 | 7 | 7.0 | 7.3 | 7 | 8.5 | 8.4 | 8.4 |
| Paper properties | | | | | | | | | | | |
| Surface size starch | | | $g/m^2$ | 2.33 | 2.43 | 2.92 | 2.69 | 2.19 | 2.58 | 2.64 | 2.82 |
| ASTM F119 c.s. | | | m.d. | 20 | 40 | 72 | 40 | 48 | 48 | 48 | 48 |

Table 7 shows that different starch extenders from the same chemical family provide improvement of oil and grease resistance. Table 7 also shows the range in which the starch extenders from the invention are active. The starch extender may be present in a weight range of 0-25 wt. %, based on the coating dry weight. Preferably the starch extender is present in a weight range (dry/dry) of 1-25 wt. %, preferably 1 to 10 wt. %, more preferably 2 to 7.5 wt. %, most preferably 2.5 to 6 wt. %, based on the coating dry weight.

Example 6

Papers were also coated with compositions as shown in table 8.

TABLE 8

| Starch type | MW | C.D. | solids | | | | | | | |
|---|---|---|---|---|---|---|---|---|---|---|
| B | 2.8 | −0.163 | % | 15 | 15 | 15 | | | | |
| Ref 7 | 0.51 | −0.07 | % | | | | 17.5 | 17.5 | 17.5 | 17.5 |
| Additive | | Type | | 0 | | | 0 | | | |
| Giluton 3640 | | PAE | Parts | | 5 | 5 | | | 5 | 5 |
| Aquapel F220 | | AKD | Parts | | | 5 | | 5 | 5 | |
| Viscosity | | | mPas | 37 | 103 | 120 | 19.8 | 22 | 23 | 52 |
| pH | | | | 7.4 | 7.0 | 7.1 | 6.8 | 6.7 | 6.6 | 6.4 |
| Surface size starch | | | $g/m^2$ | 2.23 | 2.92 | 2.81 | 2.21 | 2.10 | 2.17 | 2.21 |
| ASTM F119 c.s. | | | m.d. | 24 | 72 | 48 | 8 | 20 | 20 | 4 |

In Table 8 a comparison has been made with US2009/0297842. A solution of a non-carboxylated starch oxide, Ref 7, has been applied. The oil and grease resistance according to the ASTM test is poor and worse than a coating based on starch B.

The composition of claim 1 of US2009/0297842 comprises AKD and upon the addition of AKD the oil and grease resistance increases from 8 h to 20 h as can be seen from table 8. Table 8 also shows the combination of a starch oxide (Ref 7), PAE resin and AKD, attesting that this does not further improve the oil and grease resistance. It also follows from table 8 that addition of only the PAE resin to the non-carboxylated starch oxide does not improve the oil and grease resistance of the paper as compared to a coating of the non-carboxylated starch oxide alone. On the contrary, the oil and grease resistance reduces from 8 hours to 4 hours.

Example 7

Papers were also coated with compositions as shown in table 9.

TABLE 9

| Starch type | MW | C.D. | solids | | | | | | | |
|---|---|---|---|---|---|---|---|---|---|---|
| B | 2.8 | −0.163 | % | 15 | 15 | 15 | | | | |
| Blend of B and Ref 6 (9/1 w/w) | | | % | | | | 15 | 15 | | |
| Ref 8 | 5.6 | −0.165 | % | | | | | | 15 | 15 |
| Additive | Type | | | | | | | | | |
| Giluton 3640 | PAE | | Parts | | 5 | 5 | | 5 | | 5 |
| Aquapel F220 | AKD | | Parts | | | 5 | | | | |
| Viscosity | | | mPAs | 37 | 107 | 120 | 60 | 136 | 31.8 | 69.5 |
| pH | | | | 7.4 | 7.0 | 6.5 | 7.3 | 7.0 | 5.9 | 7 |

TABLE 9-continued

| Starch type | MW | C.D. | solids | | | | | | | |
|---|---|---|---|---|---|---|---|---|---|---|
| Surface size starch | | | g/m$^2$ | 2.23 | 2.98 | 2.81 | 2.69 | 3.35 | 2.20 | 2.1 |
| Hot grease test c.s. | | | stains | 6 | 2 | 0 | 4 | 1 | 29 | 8 |

Degraded or thinned starches having a hydrophobic substitution are also described in US2008/0193784. Degraded waxy corn OSA esters can be used to impart oil and grease resistance, although the examples in the patent show that rather high coat weights are required and that these formulation are characterized by a Brookfield viscosity of more than 200 cps (mPas) which limits its application in size press. Moreover, octenyl succinic anhydride modified thinned starches as described in US2008/0193784 appear to have a worse oil and grease resistance when the coated paper is heated in comparison to the composition of the invention as is shown in the comparative examples.

Table 9 shows the excellent grease resistance of the compositions of the invention comprising oxidized carboxylated starch, in particular those also comprising a starch extender, in comparison to a coating with an OSA-modified moderately thinned waxy corn starch.

Example 8

Different base papers with different porosities were coated with compositions of the invention. The base papers have the following porosities measured according to Gurley:

Base paper 1: 574 s/100 ml

Base paper 2: 14.1 s/100 ml

Base paper 3: 39.3 s/100 ml

The results of the assessment of the oil and grease resistance of the coated papers are shown in table 10.

TABLE 10

| | | | Base Paper | 1 | 1 | 2 | 3 |
|---|---|---|---|---|---|---|---|
| Gurley porosity before coating | | | s/100 ml | 574 | 574 | 14.1 | 39.3 |
| Starch type | MW | C.D. | solids | | | | |
| B | 2.8 | −0.163 | % | 15 | | | 20 |
| E | 6.6 | −0.13 | % | | 15 | 15 | |
| Viscosity | | | mPas | 37 | 89 | n.m | 91 |
| pH | | | — | 7.4 | 7.0 | n.m | 7.0 |
| Surface size starch | | | g/m$^2$ | 2.23 | 3.09 | 3.66 | 4.73 |
| Gurley porosity | | | s/100 ml | >1000 | >1000 | 31.4 | 237 |
| ASTM F119 c.s. | | | m.d. | 24 | 48 | <1 | 1.5 |

In table 10 a comparison has been made with WO00/06607. Starches B and E according to the invention have been applied to Base paper 1 as described in the methodology for application of the composition to paper. The same (Starch E) has been applied to ink-jet base paper obtained from Fabriano Miliano Pioraco (Base paper 2) as described in Example 12 from WO00/06607. For reference purposes, the starch of the invention has also been applied to Base paper 3 obtained from Mondi Lohja (36 g/m$^2$ OGR base paper).

Table 10 shows the influence of the porosity of the paper on oil and grease resistance. Oil and grease resistance is increased in particular for paper having low porosity prior to coating. The coating process generally decreases the porosity. The porosity prior to coating is preferably at least 250 s/100 ml, more preferably at least 500 s/100 ml. The porosity after coating is preferably larger than 250 s/100 ml, preferably more than 500 s/100 ml, more preferably more than 800 s/100 ml, most preferably more than 1000 s/100 ml.

The invention claimed is:

1. A cellulosic material having a Gurley porosity number larger than 250 s/100 ml prior to coating, provided with a coating comprising an oxidized carboxylated starch having a weight-average molecular weight of 0.3−10×10$^6$ Da;

a water-soluble starch extender present in a quantity of 0 to 25 wt. % based on the coating dry weight, selected from a crosslinked cationic polyalkylene amine and a zirconium carbonate, wherein the Gurley porosity number after coating is larger than 500 s/100 ml, and wherein said coating renders the cellulosic material oil and grease resistant.

2. A cellulosic material according to claim 1, wherein the coating comprises a water-soluble starch extender present in a quantity of 1 to 25 wt. %.

3. A cellulosic material according to claim 1, wherein the coating comprises an oxidized carboxylated starch having a charge density of lower than −0.10 μEq/mg dry solids.

4. A cellulosic material according to claim 1, wherein the crosslinked cationic polyalkylene amine is a polyamine epichlorohydrin resin, a polyamide epichlorohydrin resin, or a polyamidoamine epichlorohydrin resin.

5. A cellulosic material according to claim 1, wherein the Gurley porosity number is more than 500 s/100 m.

6. A cellulosic material according to claim 1, wherein the coating comprises an oxidized carboxylated starch without further hydroxylic substitution, and/or an oxidized carboxylated starch ether or ester.

7. A cellulosic material according to claim 1, wherein the coating comprises oxidized carboxylated starch in a quantity of 50-100 wt. %, based on the coating dry weight.

8. A cellulosic material according to claim 1, wherein the coating comprises a water-soluble starch extender in a quantity of 1-10 wt. %, based on the coating dry weight.

9. A cellulosic material according to claim 1, wherein the coating is present on the cellulosic material in a quantity of 0.5-7.5 g/m$^2$ starch per side based on dry weight.

10. A cellulosic material according to claim 1, wherein the coating further comprises a modified non-oxidized-carboxylated starch.

11. A cellulosic material according to claim 10, wherein the modified non-oxidized-carboxylated starch is a starch acetate, a starch octenyl succinate, or a starch ether selected from the group of such as hydroxypropyl starch, hydroxyethyl starch, carboxymethyl starch, starch treated with 3-chloro-2-hydroxypropyl trimethylammonium chloride and starch treated with 3-chloro-2-hydroxypropyl dimethylalkyl ammonium chloride.

12. A cellulosic material according to claim 1, wherein the cellulosic material is paper or cardboard, preferably paper.

13. A cellulosic material according to claim 1, wherein the Gurley porosity number is more than 800 s/100 ml.

14. A cellulosic material according to claim 1, wherein the Gurley porosity number is more than 1000 s/100 ml.

* * * * *